United States Patent [19]

Schmid

[11] 4,393,827

[45] Jul. 19, 1983

[54] MULTICYLINDER INTERNAL COMBUSTION ENGINE, ESPECIALLY FOR AUTOMOTIVE VEHICLES AND PROCESS FOR SUPPLYING OF A FUEL-AIR MIXTURE THERETO

[75] Inventor: Wolfgang Schmid, Markgröeningen, Fed. Rep. of Germany

[73] Assignee: Dr. Ing. h.c.F. Porsche AG, Fed. Rep. of Germany

[21] Appl. No.: 323,485

[22] Filed: Nov. 20, 1981

[30] Foreign Application Priority Data

Nov. 25, 1980 [DE] Fed. Rep. of Germany ..... 3044248

[51] Int. Cl.[3] ..... F02M 13/04; F02D 17/00

[52] U.S. Cl. ..... 123/198 F; 261/23 A

[58] Field of Search ..... 123/198 F, 580, 583, 123/584; 261/23 A, DIG. 60

[56] References Cited

U.S. PATENT DOCUMENTS

| | | | |
|---|---|---|---|
| 4,076,003 | 2/1978 | Garabedian | 261/23 A |
| 4,109,634 | 8/1978 | Garabedian | 261/23 A |
| 4,204,514 | 5/1980 | Ishida | 123/198 F |
| 4,257,371 | 3/1981 | Ishida | 261/23 A |

*Primary Examiner*—William A. Cuchlinski, Jr.
*Attorney, Agent, or Firm*—Craig & Burns

[57] ABSTRACT

A multicylinder internal combustion engine having separate cylinder groups, each of which is associated with a fuel-air mixture supply means for selectively supplying a fuel-air mixture or only air thereto, and a process for supplying of a fuel-air mixture thereto. In accordance with all embodiments, air only is supplied to the second cylinder group when the engine is operating in a warmed-up condition, under partial load operating conditions, a fuel-air mixture being supplied to both cylinder groups, regardless of engine temperature conditions, once the partial load range has been exceeded. A fuel-air mixture is supplied to the first cylinder group in accordance with all embodiments, regardless of engine temperature or load conditions. In accordance with a preferred embodiment of the engine, a single cam disk is utilized to control the air supply through the air intakes for both cylinder groups in cooperation with a vacuum cell, and a temperature controlled venting device for the vacuum cell. In accordance with the process embodiments, the fuel-air supply to the second cylinder group during warm-up is either progressively increased and then decreased to an amount approximating zero, or is held constant throughout the predetermined load range; while, with the engine warmed-up for operation, the supply of air only to the second cylinder group, in the partial load range, is either progressively increased, held constant, and then decreased to an amount approximating zero, or is increased, held constant to the end of the partial load range and then abruptly decreased to the amount approximating zero.

30 Claims, 9 Drawing Figures

MULTICYLINDER INTERNAL COMBUSTION ENGINE, ESPECIALLY FOR AUTOMOTIVE VEHICLES AND PROCESS FOR SUPPLYING OF A FUEL-AIR MIXTURE THERETO

BACKGROUND AND SUMMARY OF THE INVENTION

The invention relates to multicylinder internal combustion engines having several cylinders or cylinder groups which are associated with a respective fuel-air mixture supply means and fuel-air supply process therefor.

More particularly, the invention relates to the type of internal combustion engine disclosed in commonly assigned U.S. patent application Ser. No. 90,613, filed Nov. 2, 1979 with respect to which the present inventor is a co-inventor, wherein the activation and the deactivation of a second cylinder group takes place, in the condition warmed up for operation, in an essentially jerk-free fashion. However, this prior system does not make special adjustments to its operation in the warming-up phase of the internal combustion engine.

DAS [German Published Application] No. 1,109,947 disclosed a multicylinder internal combustion engine wherein individual cylinder groups or all cylinder groups are supplied with fuel, depending on the torque requirement, this internal combustion engine operating in the warming-up phase in all operating ranges with all cylinders. There is nothing disclosed in this DAS No. 1,109,947 to the effect that the feeding of the fuel-air mixture to the cylinders of the individual cylinder groups takes place differently in dependence on the load on the internal combustion engine.

It is an object of the invention to provide an internal combustion engine comprising various cylinders or cylinder groups, especially two cylinder groups, wherein the operating characteristic of the second cylinder group is optimized in a predetermined partial load range during the warming-up phase of the internal combustion engine and with the internal combustion engine having been warmed-up for operation.

According to the present invention, this object has been attained in accordance with preferred embodiments disclosed therein, whereby the fuel-air supply to the second cylinder group is controlled differently when the engine is warmed-up than when it is not.

The advantages obtained by the invention reside especially in that, when the internal combustion engine is warmed-up for operation, the driving comfort of the automotive vehicle is increased by a completely smooth activation and deactivation of the second cylinder group. In the warming-up phase of the internal combustion engine, the starting procedure of the internal combustion engine and the starting-up process of the automotive vehicle are improved, and the warming-up phase is considerably shortened, whereby fuel consumption is reduced and exhaust gas emission is improved.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
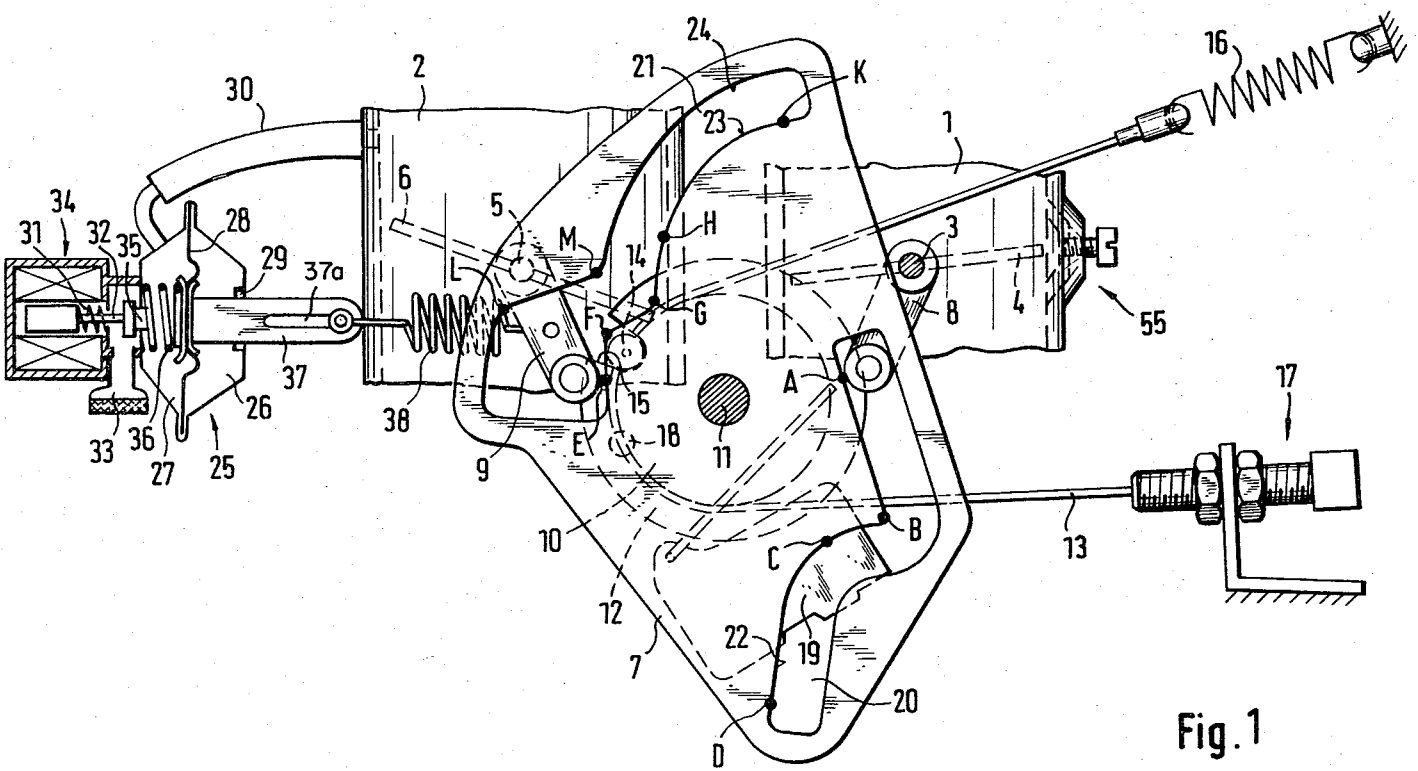
FIG. 1 shows the control for the throttle valves for both cylinder groups in the warming-up phase of the internal combustion engine, and with the internal combustion engine being warm for operation, in a first embodiment.

In FIG. 1, numeral 1 denotes an intake pipe associated with a first cylinder group of an internal combustion engine, and 2 denotes an intake pipe associated with a second cylinder group of the engine. In the intake pipe 1, a throttle valve 4 is arranged on a throttle valve shaft 3 so as to rotate therewith, and an idling adjustment device 55 is provided. In the intake pipe 2, a throttle valve 6 is arranged on a throttle valve shaft 5, to rotate therewith. The rotating of the throttle valve 4 takes place by a swivel arm control lever 8, which is fixedly joined to the throttle valve shaft 3, and cooperates with a cam disk 7. Similarly, the rotation of the throttle valve 6 is effected by a swivel arm control lever 9, fixedly joined to the throttle valve shaft 5, and cooperates with the cam disk 7.

The cam disk 7 and a guide disk 10 are fixedly arranged on a horizontal shaft 11 extending approximately in the center between the intake pipes 1 and 2 so as to be jointly rotatable. The guide disk 10 has a continuous groove 12 wherein an accelerator cable 13 is guided. A roller is fixedly connected to the cable 13 and is arranged, to prevent twisting, in an axial groove 15 on the periphery of the guide disk 10. At one end, the cable 13 is connected to a retracting spring 16 and, with the other end, guided in an adjusting device 17, the cable 13 being connected to a vehicle accelerator pedal (not shown). A control cam 18 is arranged at the cam disk 7; this cam cooperates with an electrical connector switch 19.

The cam disk 7 comprises a guide slot 20 and a guide slot 21. The inner path of the guide slot 20 is a curved path 22 which coacts with the control lever 8 in all operating ranges of the internal combustion engine, both when the engine is warmed-up for operation and when the internal combustion engine is in the warming-up phase. The inner path of the guide slot 21 is a curved path 23 which coacts with the control lever 9 in all operating ranges of the internal combustion engine in the warming-up phase of the internal combustion engine and in the operating range of the warmed-up internal combustion engine above a predetermined partial load range up to full load, only. When the engine is warm, but the predetermined partial load range has not been exceeded, the outer path of the guide slot 21 (curved path 24) coacts with the control lever 9. Control points on the curved path 22 are denoted by A, B, C and D; control points on the curved path 23 are denoted by E, F, G, H and K; and control points on the curved path 24 are denoted by L and M.

A vacuum cell 25 comprises a first (or atmospheric) chamber 26 and a second (or vacuum) chamber 27 separated from each other by a diaphragm 28. The first chamber 26 is in communication with the atmosphere via an opening 29, and the second chamber 27 is connected via a control line 30 with the intake pipe 2 so as to experience the suction pressure therein. An electromagnetic venting valve 34, comprising a compression spring 31, a valve stem 32, and a vent aperture 33, is associated with the second chamber 27 and controls, by way of the valve stem 32, the throughflow cross-section of an outlet port 35 of the second chamber 27. On the side facing the second chamber, the diaphragm 28 is biased by a compression spring 36, and on the side facing the first chamber, the diaphragm is connected via a control lever 37 and a balancing spring 38 with the control lever 9. Spring 38 is displaceably received within a slot 37*a* of lever 37 so that lever 37 only acts on lever 9 when drawn into chamber 27, and lever 9 can be moved under full load conditions without interference from spring 36 and lever 37.

The fuel-air mixture supply and the air supply, respectively, achieved by cam disk 7 of the FIG. 1 embodiment will now be described with the aid of the control diagram of FIG. 2. The accelerator pedal position is plotted on the abscissa 39, and the throttle valve positions are marked on the ordinate 40. The end of a predetermined partial load range 41 is indicated by a dot-dash line 42. The curve 43 depicts the first cylinder group in all operating ranges of the internal combustion engine, whether or not it is warmed-up, and is the same behavior produced for the first cylinder group of the above-noted, commonly assigned Ser. No. 90,613; the curve 44 represents the second cylinder group with only air supplied in the predetermined partial load range 41 when the internal combustion engine is warmed-up for operation; curve 45 shows the second cylinder group with fuel-air mixture supplied in the predetermined partial load range 41 during the warming-up operational phase of the internal combustion engine, and corresponds to the behavioral curve for the second cylinder group of Ser. No. 90,613 for air only with both a cold and a warmed-up engine; curve 46 identifies the second cylinder group with fuel-air mixture supplied in all operating ranges of the internal combustion engine from the end of the predetermined partial load range up to full load, whether or not the engine is in a warmed-up condition, and, again, corresponds to that of Ser. No. 90,613; and line 47 depicts the fuel supply for the second cylinder group with the internal combustion engine warmed-up for operation, and is also like that of Ser. No. 90,613. On the ordinate 40, the point 48 symbolizes the condition of interrupted fuel supply, and point 49, the condition of released fuel supply for the second cylinder group with the internal combustion engine warmed-up for operation; point 50 denotes the position of the closed throttle valve 4; point 51 identifies the position of the fully opened throttle valve 4 of the first cylinder group; point 52 depicts the purely theoretical position of the closed throttle valve 6 of the second cylinder group; point 53 shows the position of the fully opened throttle valve 6; point 66 identifies the position of the throttle valve 6, when the internal combustion engine is at a standstill, upon the abutment of control lever 9 against the control point E of the cam path 23; point 67 shows the position of the throttle valve 6 during idling of the internal combustion engine; and point 54 shows the position of the throttle valve 6 when the control lever 6 is in contact with the cam path 24 below the control point L.

Figure 2:
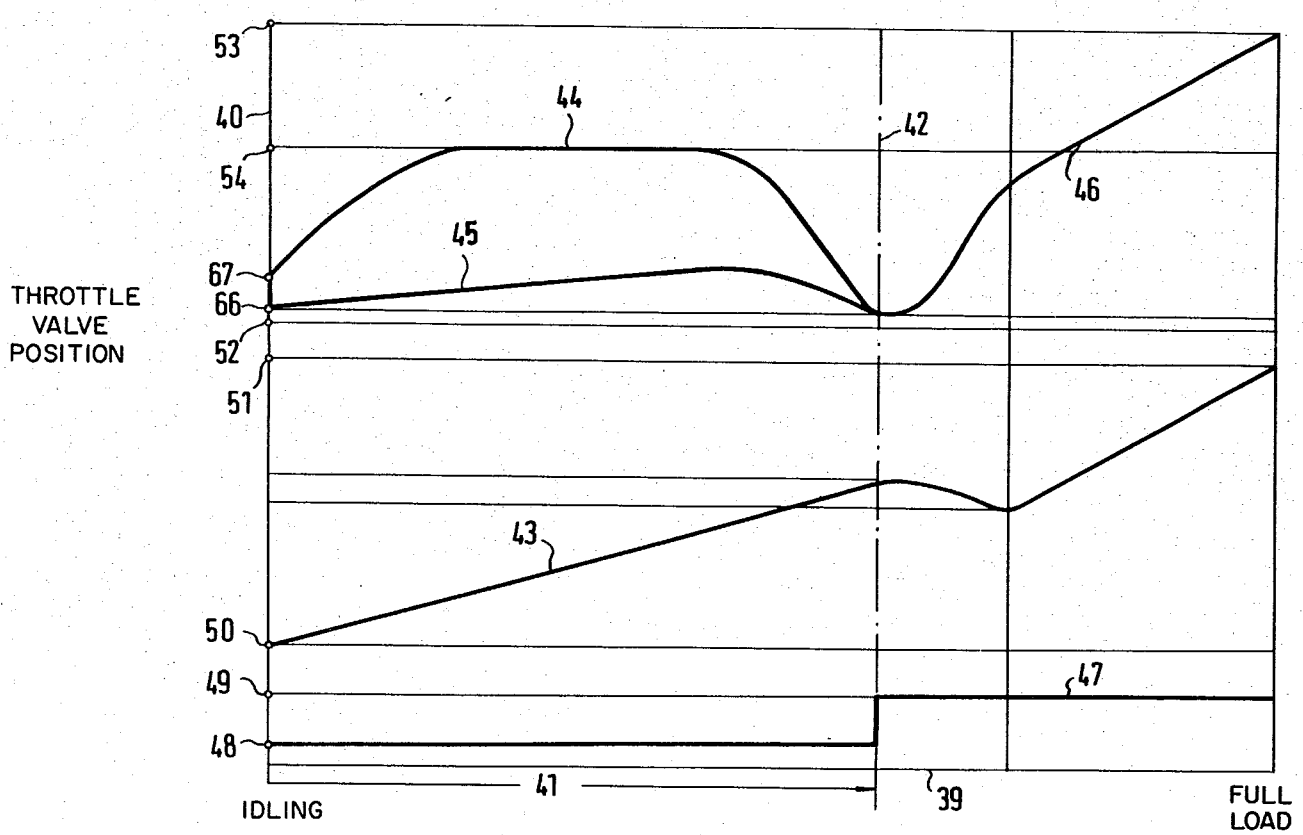
FIG. 2 is a control diagram showing the fuel-air mixture supply and air supply for both cylinder groups of the internal combustion engine in the embodiment of FIG. 1.
Figure 3:
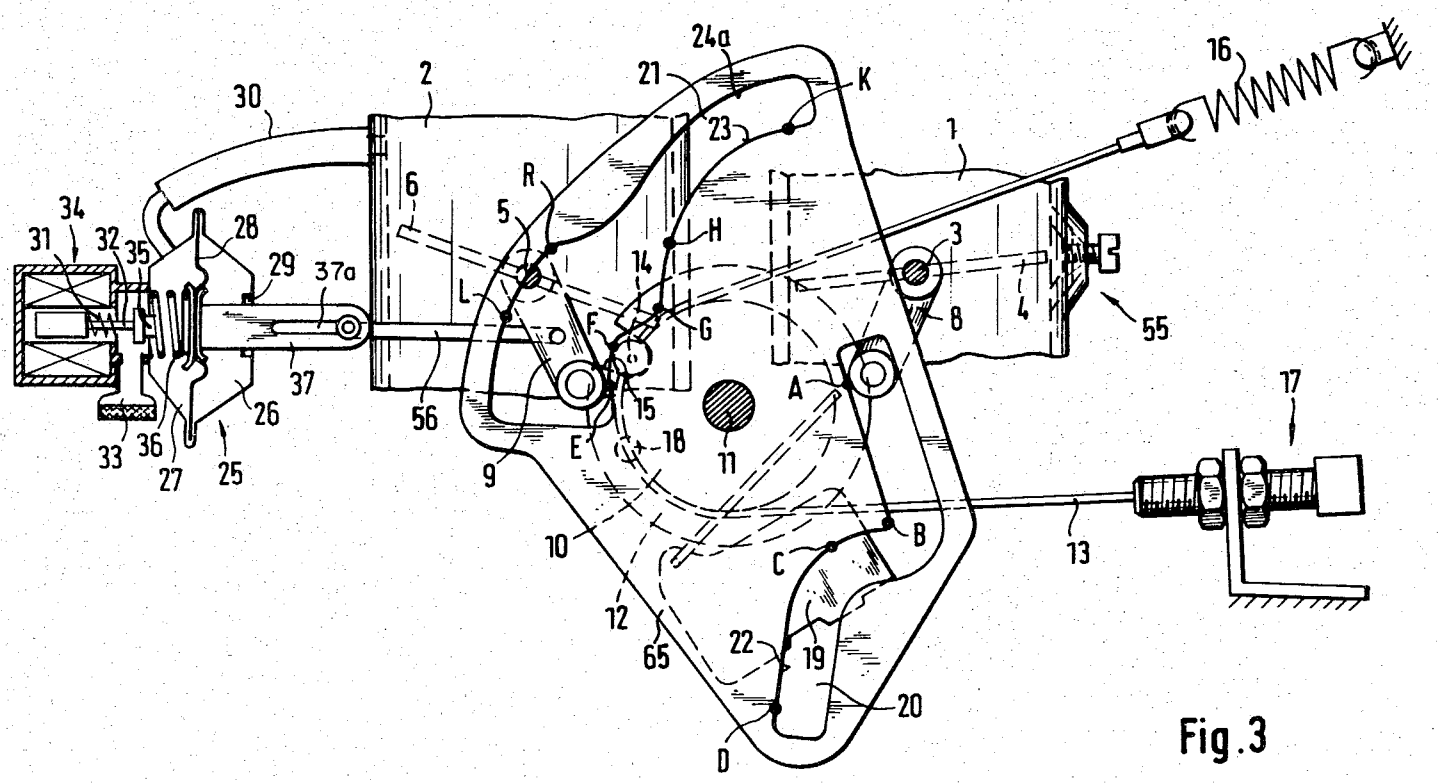
FIG. 3 shows the control for the throttle valves for both cylinder groups in the warming-up phase of the internal combustion engine, and with the internal combustion engine being warm for operation, in a second embodiment.
Figure 4:
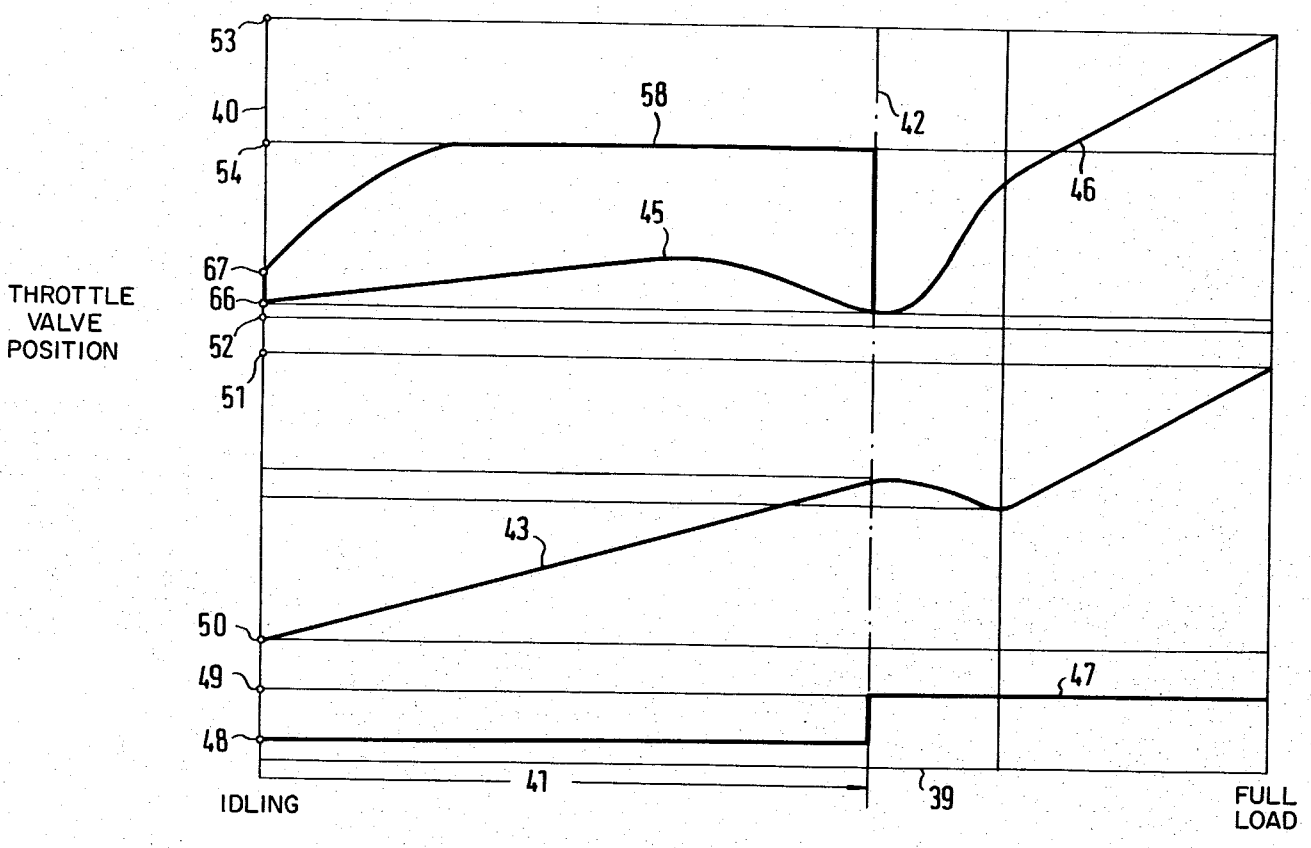
FIG. 4 is a control diagram showing the fuel-air mixture supply and air supply for both cylinder groups in the embodiment of FIG. 3.

Identical reference symbols are utilized, as in the embodiment of FIGS. 1 and 2, for the same parts illustrated in the embodiments of the invention of FIGS. 3 and 4; 5 and 6; and 7 and 8, respectively.

In the embodiment of FIGS. 3 and 4, a cam disk, cooperating with the swivel arms 8 and 9, is denoted by 65, and the swivel arm 9 is connected to the diaphragm 28 of the vacuum cell 25 via the control lever 37 and a control lever 56 articulated to the control lever 37 and the control lever 9. Cam disk 65 differs from cam disk 7 of the FIGS. 1 and 2 embodiment in that a control point R, symbolizing the switch-on point for the fuel supply for the second cylinder group, is arranged on a curved path 24*a* along with the control point L. A curve denoted by 58 illustrates the second cylinder group with only air supplied in the predetermined partial load range 41 with the internal combustion engine having been warmed-up for operation. The curves 22 an 23 are the same as those of the FIG. 1 embodiment. Control lever 56 is displaceably connected to the lever 37 via slot 37*a* in the same manner and for the same purpose noted with regard to spring 38. The substitution of lever 56 for spring 38 is necessary to achievement of the curve shapes shown in FIG. 4 relative to those of FIG. 2.

Figure 5:
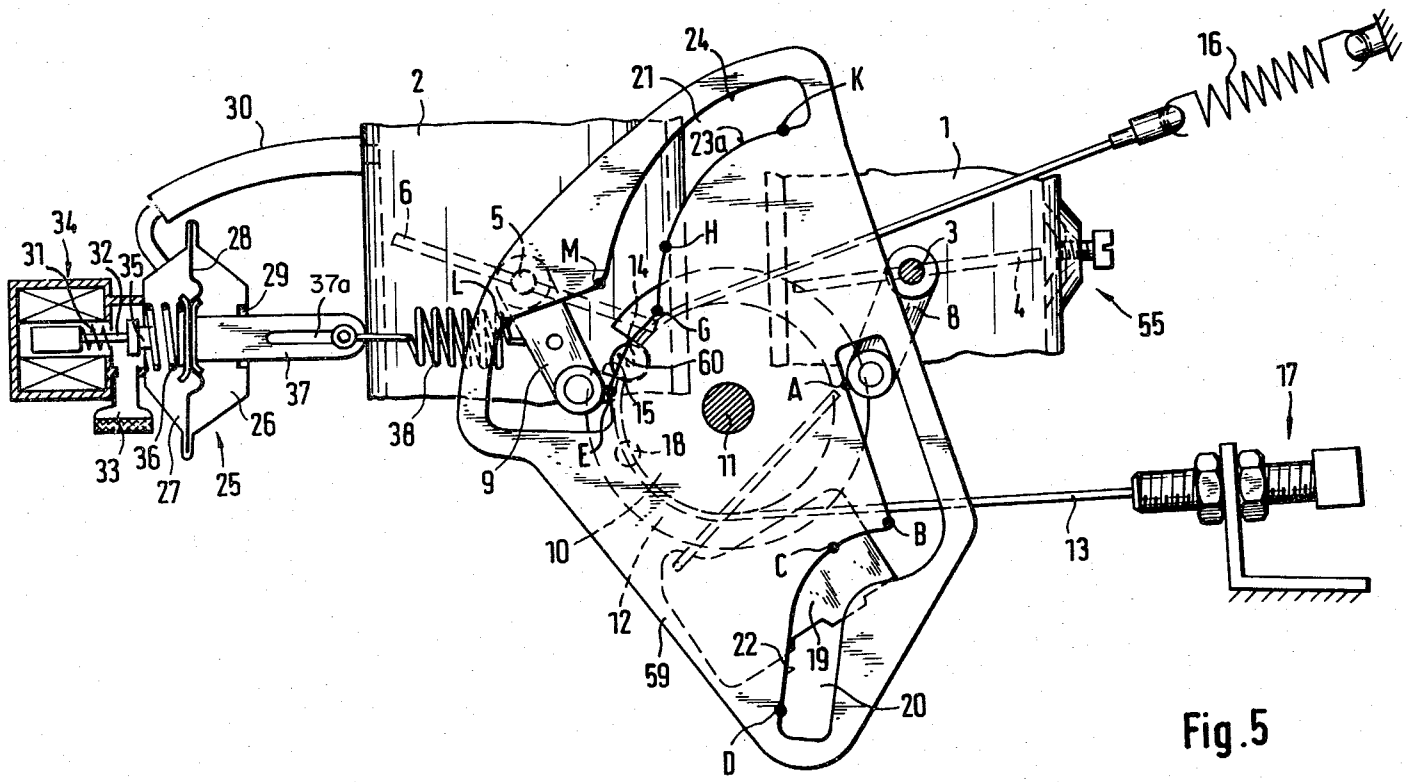
FIG. 5 shows the control for the throttle valves for both cylinder groups in the warming-up phase of the internal combustion engine, and with the internal combustion engine being warm for operation, in a third embodiment.
Figure 6:
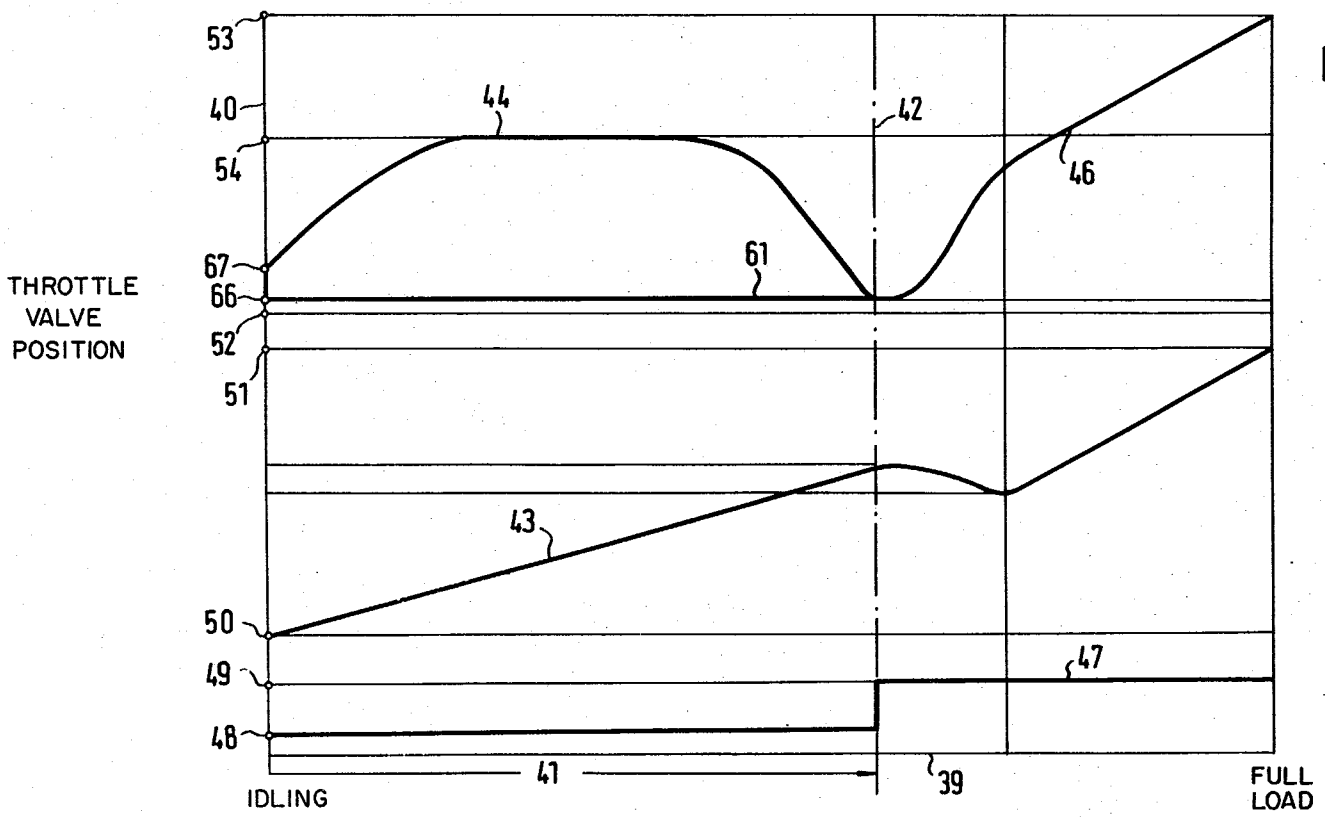
FIG. 6 is a control diagram showing the fuel-air mixture supply and air supply for both cylinder groups of the internal combustion engine in the embodiment of FIG. 5.

In the embodiment of FIGS. 5 and 6, a cam disk, cooperating with the swivel arms 8 and 9, is denoted by 59. This cam disk 59 differs from the cam disk 7 of the embodiment of the invention according to FIGS. 1 and 2 by the fact that a curved path section 60 lies between the control points E and G of the curved path 23*a*, which section has no control point and is designed in such a way that the position of the throttle valve 6 is not adjusted between control points E and G. A curve denoted by 61 illustrates the second cylinder group with fuel-air mixture supply in the predetermined partial load range 41 in the warming-up phase of the internal combustion engine. Curves 22 and 24 are the same as in the FIG. 1 embodiment.

Figure 7:
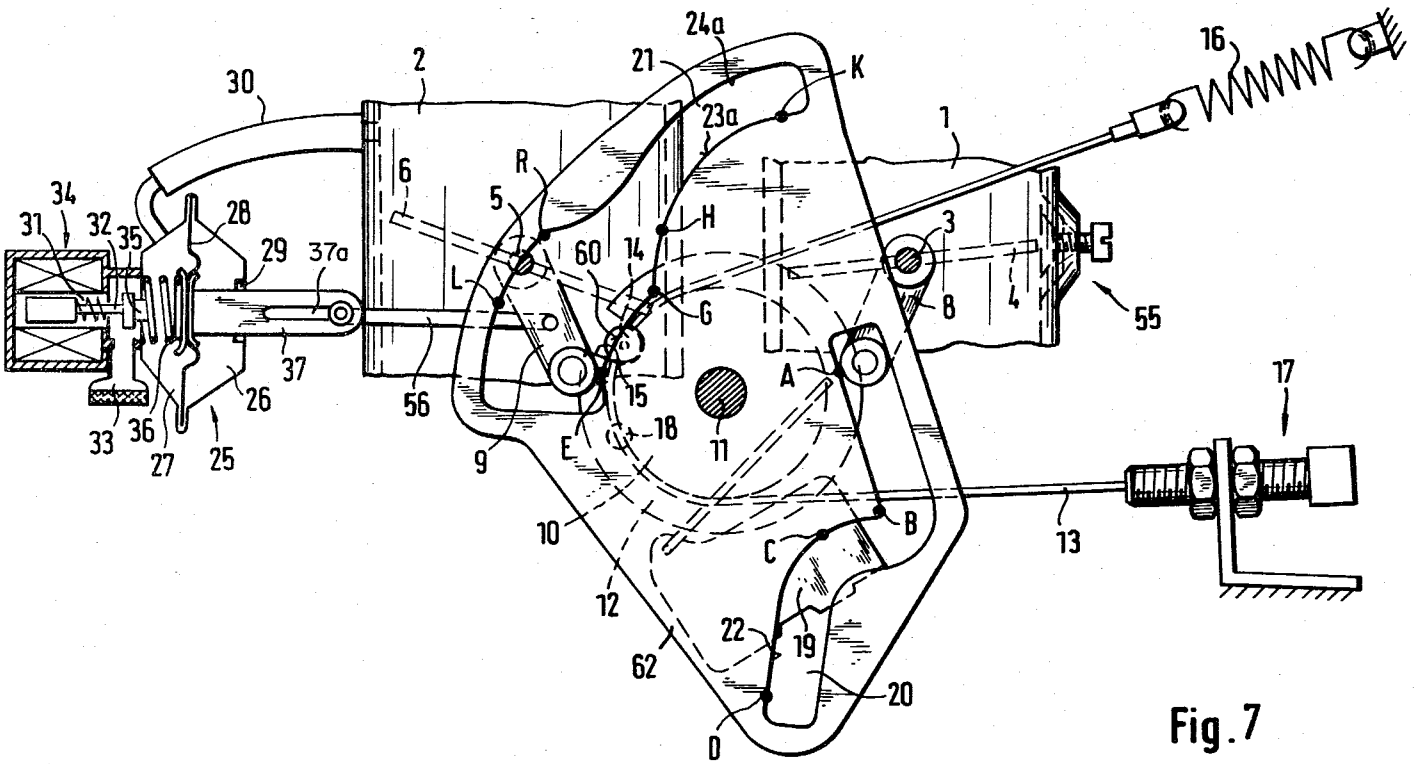
FIG. 7 shows the control for the throttle valves for both cylinder groups in the warming-up phase of the internal combustion engine, and with the internal combustion engine being warm for operation, in a fourth embodiment.
Figure 8:
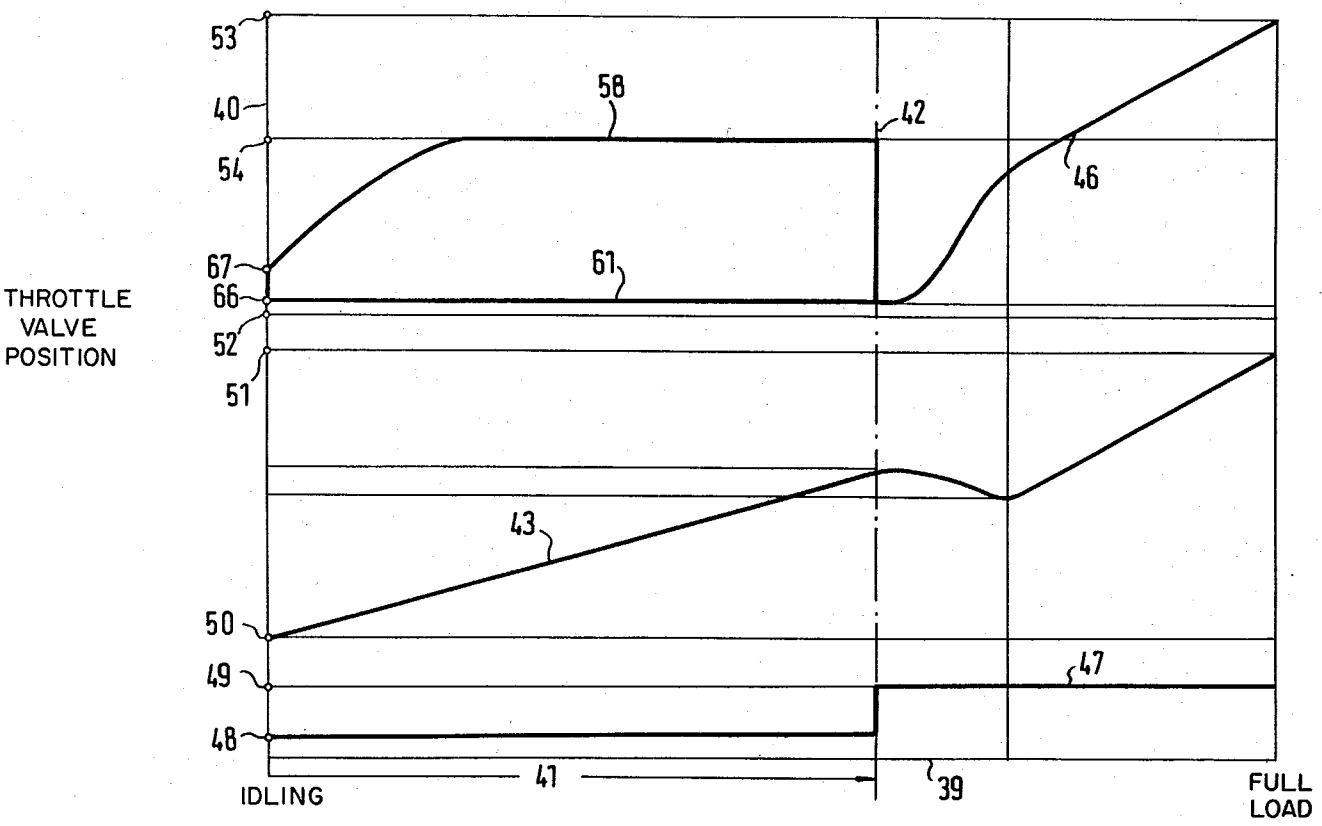
FIG. 8 is a control diagram showing the fuel-air mixture supply and air supply for both cylinder groups of the internal combustion engine in the embodiment of FIG. 7.

In the embodiment of FIGS. 7 and 8, a cam disk, cooperating with the swivel arms 8 and 9, is denoted by 62. This cam disk 62 differs from the cam disk 55 of the embodiment of the invention according to FIGS. 3 and 4 in that the curved path section 60 is arranged between the control points E and G in the manner of the embodiment of FIGS. 5 and 6. The curve 61 depicts, just as in the embodiment of the invention according to FIGS. 5 and 6, the second cylinder group with fuel-air mixture supply in the predetermined partial load range 41 in the warming-up phase of the internal combustion engine, while the curve 58 conforms to that of FIG. 4.

Figure 9:
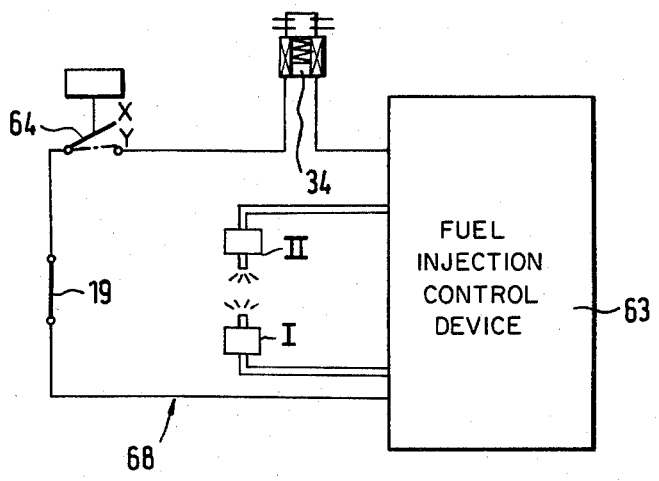
FIG. 9 shows an electrical circuit diagram for the embodiments of the invention according to FIGS. 1 through 8.

In the electrical circuit diagram of FIG. 9, 63 denotes a conventional control device of the fuel injection system (for example, as used in the "L-Jetronic" fuel injection systems of Bosch (Bosch Technische Unterrichnung Benzineinspritzung D-Und L-Jetronic, 1975)) which can act on electromagnetically operable fuel injection valves I and II. The control device 63 is regulated by a switch-on circuit 68, which later can be influenced by a temperature switch 64 and the electrical connector switch 19. The electromagnetic venting valve 34 is arranged in the switch-on circuit 68. The venting valve 34, the temperature switch 64, and the activating switch 19 are connected in series. The switch-on circuit 68 had the effect that, with the switch-on circuit 68 being opened (position x), both cylinder groups are supplied with fuel-air mixture.

The operation of the embodiment of this invention according to FIGS. 1 and 2 is as follows:

With the internal combustion engine being at a standstill, the control lever 8 is in contact with the control point A of the first cylinder group, and the control lever 9 is in contact with the control point E of the second cylinder group. The throttle valve 4 is closed, and the throttle valve 6 is slightly open (control point 66, FIG. 2).

After starting the operation of the internal combustion engine, having been warmed-up for operation, the engine is idling; the cam disk 7 is in the illustrated position; the temperature switch 64, the electrical connector switch 19, and the venting valve 34 are closed. With the switch-on circuit 68 being in this closed position, the control device 63 effects that fuel-air mixture is supplied only to the first cylinder group, and the control lever 8 remains in contact with the control point A, whereas the control lever 9, due to the vacuum in the intake pipe 2, is slightly lifted off the control point E by the vacuum cell 25 and, thus, the opening angle of the throttle valve 6 is slightly increased (control point 67, FIG. 2). The throttle valve 4 remains closed, so that air for the idling fuel-air mixture is supplied to the first cylinder group via the idling adjustment device 55, and, with the fuel supply cut off, air is supplied to the second cylinder group via the slightly open throttle valve 6, whereby the latter acts as an air pump.

From idling to the end of the predetermined partial load range 42, the cam disk 7 slides with its curved path 22 to the control point B along the control lever 8 of the first cylinder group, during which procedure the amount of fuel-air mixture fed to the first cylinder group is continuously increased.

At the same time, the control lever 9, due to the rising vacuum in the intake pipe 2 and, consequently, in the second chamber 27 of the vacuum cell 25, is pivoted against the spring force of the compression spring 36 via the control lever 37 and the balancing spring 38 in the direction of the curved path 24. The vacuum cell 25 is designed so that, when a predetermined engine rpm has been reached, control lever 9 comes into contact with the curve path 24 below the control group being continuously increased up to that point. Below this predetermined speed, the control lever 9 moves in dependence on the number of revolutions in a freely-floating fashion between the curved path 23 and the curved path 24. Assuming that the control lever 9 has come into contact with the curved path 24, as the accelerator pedal is depressed, causing rotation of cam disk 7, the control lever 9 slides along the curved path 24 until it reaches the control point L, during which step the amount of air fed to the second cylinder group remains the same, and then up to the control point M symbolizing the end of the predetermined partial load range, up to which point the amount of air is continuously reduced up to an amount slightly above zero (control point 66, FIG. 2). If the control lever 9 moves in a freely-floating fashion in dependence upon the engine rpm between the curved path 23 and the curved path 24, and the cam disk 7 is further rotated in the direction toward full load of the internal combustion engine, then the control lever 9 will come into contact with the curved path 24 at a point between the control point L and the control point M in correspondence with engine rpm so that the amount of air fed to the first cylinder group is appropriately decreased to as low a quantity as slightly above zero at control point M.

Upon reaching the control points B and M (line 42, FIG. 2), the electrical connecting switch 19 is opened by the control cam 18 arranged on the cam disk 7, so that the switch-on circuit is interrupted and thus fuel-air mixture is supplied to both cylinder groups by the control device 63. By the interruption of the switch-on circuit 68, the venting valve 34 also has no longer any voltage applied thereto, so that the vacuum cell 25 is vented due to the valve stem 32, which is displaced by the bias of the compression spring 31 and opens the outlet port 35. Thereby, the throttle valve 6 is turned by its return spring (not shown), when lever 37 and the balancing spring 38 are shifted by the spring force of the compression spring 36, in the closing direction to such an extent that the control lever 9 comes into contact with the control point G of the curved path 23 (control point 66, FIG. 2)

After passing through the predetermined partial load range, the cam disk 7 slides, on the one hand, with its curved path 22 along the control lever 8 of the first cylinder group up to control point C, and, on the other hand, with its curved path 23 along the control lever 9 of the second cylinder group up to control point H. During this step, the amount of fuel-air mixture supplied to the first cylinder group is continuously reduced for such a time period, and the amount of fuel-air mixture fed to the second cylinder group is continuously increased for such a time period, that the amounts of fuel-air mixture for both cylinder groups are of the same magnitude in control points C and H, the noted continuous reduction of the quantity of fuel-air mixture fed to the first cylinder group taking place to a lesser extent than the continuous increase in the amount of fuel-air mixture supplied to the second cylinder group.

If the gas pedal is further moved in the direction toward full load, the cam disk 7 slides, on the one hand, with its curved path 22 along the control lever 8 of the first cylinder group up to a control point D, and, on the other hand, with its curved path 23 along the control lever 9 of the second cylindar group up to a control point K which, just as control point D, symbolizes the full load of the internal combustion engine, the amounts of fuel-air mixture for both cylinder groups being increased continuously to the same degree.

When the cold internal combustion engine is started up, the cam disk 7 is located in the illustrated position; the activating switch 19 is closed; and the temperature switch 64 is opened.

The switch-on circuit 68 is interrupted by the opened temperature switch 64 so that both cylinder groups are supplied with fuel-air mixture and the vacuum cell 25 is vented by the venting valve 34. The internal combustion engine thus operates as early as during starting with both cylinder groups. During idling of the internal combustion engine, the control lever 8 is in contact with control point A, and the control lever 9 is in contact with control point E. During this stage, the first cylinder group is fed with air for the idling fuel-air mixture via the idling adjustment device 55, and the second cylinder group is fed with air for the idling fuel-air mixture via the slightly opened throttle valve 6 (control point 67, FIG. 2), so that the internal combustion engine operates at an increased idling speed.

From idling up to the end of the predetermined partial load range, the cam disk 7 slides with its curved path 22 along the control lever 8 of the first cylinder group up to control point B, during which procedure the amount of fuel-air mixture fed to the first cylinder group is continuously increased. At the same time, the cam disk 7 slides with its curved path 23, first of all, to control point F, symbolizing the end of a first part of the predetermined partial load range, up to which point the amount of fuel-air mixture fed to the second cylinder group is continuously raised; and then it slides from control point F up to a control point G, symbolizing the end of the predetermined partial load range. Between the points F and G, the amount of fuel-air mixture is continuously reduced to a quantity close to zero.

After passing through the predetermined partial load range, the cam disk 7 slides, on the one hand, with its curved path 22 along the control lever 8 of the first cylinder group up to control point C and, on the other hand, with its curved path 23 along the control lever 9 of the second cylinder group up to control point H. During this step, the amount of fuel-air mixture supplied to the first cylinder group is continuously reduced for such a time, and the amount of fuel-air mixture fed to the second cylinder group is continuously increased for such a time, that the amounts of fuel-air mixture for both cylinder groups in control points H and C are of equal size, and the continuous reduction of the amount of fuel-air mixture fed to the first cylinder group takes place to a lesser extent than the continuous increase in the amount of fuel-air mixture supplied to the second cylinder group.

If the gas pedal is moved further in the direction toward full load, the cam disk 7 slides, on the one hand, with its curved path 22 along the control lever 8 of the first cylinder group up to a control point D, and, on the other hand, with its curved path 23, along the control lever 9 of the second cylinder group up to a control point K, symbolizing, just as the control point D, the full load of the internal combustion engine, the amounts of fuel-air mixture for both cylinder groups being continuously increased to the same extent.

The above-noted behavior with a cold engine between points E–K and B–D is the same as with a warm engine and, once the internal combustion engine has reached a predetermined warm-up temperature, the temperature switch 64 is closed.

If the internal combustion engine, upon reaching the predetermined warm-up temperature, is operated in the zone of the predetermined partial load range, the activating switch 19 is closed and the switch-on circuit 68 is closed by the closing temperature switch 64. The venting valve 34 is closed, so that the position of the throttle valve 6 of the second cylinder group is affected by the vacuum cell 25 in dependence on the vacuum in the intake pipe, and fuel is fed only to the first cylinder group by the control device 63.

If the internal combustion engine, upon reaching the predetermined warm-up temperature, is operated in the zone above the predetermined partial load range, then the closing of the temperature switch 64 has no effect on the control device 63, since the switch-on circuit 68 is interrupted by the fact that the activating switch 19 is opened in this operating range of the internal combustion engine, and thus, both cylinder groups are fed with fuel by the control device 63 even with the temperature switch 64 being closed. The venting valve 34 is likewise opened, so that the position of the throttle valve 6 is affected by the curved path 23.

The embodiment of the invention illustrated in FIGS. 3 and 4 differs from the embodiment of FIGS. 1 and 2 essentially in that the position of the throttle valve 6 for supplying air to the second cylinder group takes place within the predetermined partial load range in dependence on the vacuum in the intake pipe 2, independently of the curved path 24*a*.

The feed of the fuel-air mixture for the first cylinder group in the warming-up phase of the internal combustion engine and with the internal combustion engine being warm for operation is regulated by affecting the position of the throttle valve 4 on account of the curved path 22, as has been described above in connection with the embodiment of FIGS. 1 and 2, and the supply of the fuel-air mixture for the second cylinder group in the warming-up phase of the internal combustion engine takes place by affecting the position of the throttle valve 6 by the curved path 23, likewise in the way as has been described in connection with the embodiment of FIGS. 1 and 2.

With the internal combustion engine at a standstill, the control lever 8 is in contact with the control point A of the first cylinder group, and the control lever 9 is in contact with the control point E of the second cylinder group. During this stage, the throttle valve 4 is closed, and the throttle valve 6 is slightly opened.

After starting up of the internal combustion engine in a condition warmed-up for operation, the engine is idling, the cam disk 65 is in the illustrated position, the temperature switch 64, the activating switch 19, and the venting valve 34 are closed. Fuel-air mixture is only fed to the first cylinder group by the control device 63, and the control lever 8 continues to be in contact with the control point A, whereas the control lever 6, due to the vacuum in the intake pipe 2, is slightly lifted off the control point E by the vacuum cell 25, and thus the opening angle of the throttle valve 6 is slightly increased, whereby the latter acts on an air pump.

From idling up to the end of the predetermined partial load range 42, the cam disk 65 slides with its curved path 22 along the control lever 8 of the first cylinder group up to control point B, the amount of fuel-air mixture fed to the first cylinder group being continuously increased. At the same time, the control lever 9 is pivoted in the direction of the curved path 24*a* due to the rising vacuum in the intake pipe 2 and, consequently, in the second chamber 27 of the vacuum cell 25, against the spring force of the compression spring 36, by way of the control lever 37 and the contol lever 56. The vacuum cell 25 is designed in such a way that, when a predetermined engine rpm occurs, the control lever 9 comes into contact with the curved path 24*a* below the control point L, the amount of air fed to the second cylinder group being continuously increased up to that point. Below this predetermined engine rpm, the control lever 9 moves in dependence on the engine rpm in a freely-floating manner between the curved path 23 and the curved path 24*a*. Assuming that the control lever 9 has come into contact with the curved path 24*a*, the control lever 9 then slides along the curved path 24*a* until it reaches the control point L, the amount of air fed to the second cylinder group remaining the same, and then slides up to a control point R, symbolizing the end of the predetermined partial load range, up to which point the amount of air furthermore remains the same.

Upon reaching the control point R, the activating switch 19 is opened by the control cam 18 arranged on the cam disk 55, whereby, on the one hand, the fuel supply to the second cylinder group is activated via the control device 63, and, on the other hand, the venting valve 34 is opened and thus the vacuum cell 25 is vented on account of the valve stem 32, which is displaced by the spring force of the compression spring 31 and opens the outlet port 35. Thereby, the throttle valve 6 is rotated, as the control levers 37 and 56 are shifted by the compression spring 36, in the direction toward the closed position until the control lever 9 comes into contact with the control point G of the curved path 23.

The regulation of the fuel-air supply for the first cylinder group from control point B up to control point D, as well as the regulation of the supply of the fuel-air mixture for the second cylinder group from control point G to control point K thus takes place with the internal combustion engine warmed-up for operation, as has been described in the embodiment of FIGS. 1 and 2.

The embodiment illustrated in FIGS. 5 and 6 according to this invention differs from the embodiment of FIGS. 1 and 2 by the feature that the feeding of the fuel-air mixture to the second cylinder group remains the same in the predetermined partial load range during the warming-up phase of the internal combustion engine.

The regulation of the fuel-air mixture supply for the first cylinder group in the warming-up phase of the internal combustion engine and with the internal combustion engine warmed up for operation takes place by affecting the position of the throttle valve 4 by the curved path 22, as has been described in connection with the embodiment of FIGS. 1 and 2, and the regulation of the supply for the second cylinder group in the predetermined partial load range with the internal combustion engine warmed-up for operation, and the regulation of the supply of the fuel-air mixture for the second cylinder group above the predetermined partial load range up to the full load with the internal combustion engine warmed-up for operation likewise take place, as has been described in the embodiment of FIGS. 1 and 2.

When the cold internal combustion engine is started up, the cam disk 59 is in the illustrated position; the activating switch 19 is closed; and the temperature switch 64 is opened. By the opened temperature switch 64, the switch-on circuit 68 is interrupted, so that fuel-air mixture is fed to both cylinder groups, and the vacuum cell 25 is vented by the venting valve 34.

During idling of the internal combustion engine, the control lever 8 is in contact with the control point A, and the control lever 9 contacts the control point E. The first cylinder group is supplied with air for the idling fuel-air mixture via the idling adjustment device 55, and the second cylinder group is supplied with air for the idling fuel-air mixture via the slightly opened throttle valve 6, so that the second cylinder group runs at an increased idling speed.

From idling up to the end of the predetermined partial load range, the cam disk 7 slides in its curved path 22 up to control point B along the control lever 8 of the first cylinder group, the amount of fuel-air mixture fed to the first cylinder group being continuously increased. At the same time, the cam disk 7 slides with the curved path section 60 of the curved path 23 up to the control point G, during which step the amount of fuel-air mixture fed to the second cylinder group remains the same.

The regulation of the supply of fuel-air mixture for the first cylinder group from control point B up to control point D, in the same way as the regulation of the feed of the fuel-air mixture to the second cylinder group, as well as the regulation of the control device 63 by the switch-on circuit 68, take place in dependence on the activating switch 19 and the temperature switch 64 in the warming-up phase of the internal combustion engine in the way as has been described hereinabove in connection with the embodiment of FIGS. 1 and 2.

The embodiment of the invention illustrated in FIGS. 7 and 8 differs from the embodiment of FIGS. 3 and 4 in that the feeding of the fuel-air mixture to the second cylinder group remains the same in the predetermined partial load range during the warming-up phase of the internal combustion engine.

The regulation of the supply of fuel-air mixture for the first cylinder group in the warming-up phase of the internal combustion engine and with the internal combustion engine warmed-up for operation takes place by affecting the position of the throttle valve 4 by the curved path 22 in the way as has been described in the embodiment of FIGS. 1 and 2; and the feeding of the fuel-air mixture to the second cylinder group in the warming-up phase of the internal combustion engine takes place by affecting the position of the throttle valve 6 by the curved path 23*a* and the curved path section 60 in a manner as has been described in connection with the embodiment of FIGS. 5 and 6. In contrast thereto, the regulation of the supply of fuel-air mixture for the second cylinder group with the internal combustion engine warmed-up for operation takes place in the predetermined partial load range in such a way as has been disclosed in connection with the embodiment of FIGS. 3 and 4, and takes place above the predetermined partial load range up to the full load of the internal combustion engine in the way described above in connection with the embodiment of FIGS. 1 and 2.

While I have shown and described various embodiments in accordance with the present invention, it is understood that the same is not limited thereto, but is susceptibel of numerous changes and modifications as known to those skilled in the art and I, therefore, do not wish to be limited to the details shown and described herein, but intend to cover all such changes and modifications as are encompassed by the scope of the appended claims.

I claim:

1. Multicylinder internal combustion engine having separate cylinder groups, each cylinder group being associated with a fuel-air mixture supply means for selectively supplying a fuel-air mixture or only air thereto, wherein each cylinder group is associated with a throttle valve arranged in an intake pipe, each throttle valve being connected to a control lever and the position of the throttle valves being variable by an accelerator pedal actuated cam disk which is arranged to coact with the control levers, the control lever connected to the throttle valve that is associated with the first cylinder group coacts with a single curved path of the cam disk in all operating ranges of the internal combustion engine, both when the engine is warmed-up for operation and in the warming-up phase of the internal combustion engine; the control lever connected to the throttle valve that is associated with the second cylinder group coacts with a first curved path, that is correlated with a predetermined partial load range, when the internal combustion engine is warmed-up for operation, and coacts with a second curved path, that is correlated with all operating ranges of the internal combustion engine, in the warming-up phase of the internal combustion engine and when the engine is warmed-up, about the predetermined partial load range up to full load, characterized in that said single curved path cooperating with the control lever of the first cylinder group is an inner path of a first guide slot, said first curved path coacting with the control lever of the second cylinder group is an outer path of a second guide slot, and said second curved path coacting with the control lever of the second cylinder group is an inner path of said second guide slot.

2. Multicylinder internal combustion engine according to claim 1, characterized in that displacement of the control lever connected to the throttle valve associated with the second cylinder group can be affected, via a control lever and a balancing spring, by a vacuum cell that is responsive to the vacuum in the intake pipe of the second cylinder group, said vacuum cell being ventable by a venting valve.

3. Multicylinder internal combustion engine according to claim 1, characterized in that displacement of the control lever connected to the throttle valve associated with the second cylinder group can be affected, via control levers, by a vacuum cell cooperating with the vacuum in the intake pipe of the second cylinder group, said vacuum cell being ventable by a venting valve.

4. Multicylinder internal combustion engine according to claim 1, characterized in that the control lever connected to the throttle valve associated with the second cylinder group, with the internal combustion engine being at a standstill, is in contact with the second curved path, and the throttle valve connected thereto is slightly opened at this stage.

5. Multicylinder internal combustion engine according to claim 1, characterized in that displacement of the control lever connected to the throttle valve associated with the second cylinder group can be affected, via a control lever and a balancing spring, by a vacuum cell that is responsive to the vacuum in the intake pipe of the second cylinder group, said vacuum cell being ventable by a venting valve, wherein said cam disk and vacuum cell coact with the throttle valve associated with the second cylinder unit forming a means for causing, during the warming-up of the engine, a fuel-air mixture to be supplied to the cylinders of the second cylinder group in all operating ranges in an amount that is continuously increased in a first portion of said predetermined partial load range and is continuously decreased to a quantity approximating zero in a remaining portion of the partial load range, and with the engine warmed up for operation, only air to be supplied to said second cylinder group throughout said partial load range.

6. Multicylinder engine according to claim 5, wherein the supply of air only produced by said means for causing, with the engine warmed-up, is continuously increased in a first part of said partial load range, held constant in a second part of the partial load range, and reduced to an amount approximating zero at the end of the partial load range.

7. Multicylinder engine according to claim 5, wherein said means for causing is operable to continuously reduce the supply of only air between said second part of the partial load range and the end thereof.

8. Multicylinder engine according to claim 7, wherein said means for causing is operable for maintaining said constant supply of air only to the end of the partial load range and abruptly reducing the air supply to said amount approximating zero thereat.

9. Multicylinder engine according to claim 3, wherein said cam disk and vacuum cell coact with the throttle valve associated with the second cylinder unit forming a means for causing, during the warming-up of the engine, a fuel-air mixture to be supplied to the cylinders to the second cylinder group in all operating ranges in an amount that is maintained constant throughout the predetermined partial load range, and with the engine warmed-up for operation, only air to be supplied to said second cylinder group throughout said partial load range.

10. Multicylinder engine according to claim 9 wherein the supply of air only produced by said means for causing, with the engine warmed-up, is continuously increased in a first part of said partial load range, held constant in a second part of the partial load range, and reduced to an amount approximating zero at the end of the partial load range.

11. Multicylinder engine according to claim 10, wherein said means for causing is operable to continuously reduce the supply of only air between said second part of the partial load range and the end thereof.

12. Multicylinder engine according to claim 11, wherein said means for causing is operable for maintaining said constant supply of air only to the end of the partial load range and abruptly reducing the air supply to said amount approximating zero thereat.

13. A multicylinder internal-combustion engine having at least two cylinder groups to which, in each case, one fuel-air-mixture feeding device having fuel-injection valves that can be influenced by a control mechanism, is assigned, in which case, each cylinder group is assigned one throttle valve disposed in the intake tube, with the position of said throttle valve being changeable by means of a cam disk by the accelerator pedal, and in which case, the cam disk interacts with first and second control levers firmly disposed on the throttle valve shafts with respect to rotation, in which case, when the internal-combustion engine is warmed up until the end of a predetermined partial-load range is reached, a fuel-air mixture is supplied to a first cylinder group and air is supplied to a second cylinder group in such a way that the air volume in a remaining part of the partial load range that is connected to a first part, is decreased to a volume of approximately zero, and in which case, after passing through the predetermined partial-load range until a full-load is reached, a fuel-air-mixture is supplied to both cylinder groups, characterized in that said first control lever of the second cylinder group interacts with two curved tracks, in which case the first curved track is developed for the predetermined partial-load range in the case of a warmed-up internal-combustion engine, and the second curved track is developed for all operational ranges of the internal-combustion engine in the warming up phase of the internal-combustion engine and for the operational range of the internal-combustion engine above the predetermined partial-load range up to the full load in the case of a warmed-up internal-combustion engine.

14. Multicylinder internal combustion engine according to claim 13, characterized in that the control lever connected to the throttle valve associated with the second cylinder group, with the internal combustion engine being at a standstill, is in contact with the second curved path, and the throttle valve connected thereto is slightly opened at this stage.

15. Multicylinder engine according to claim 13, wherein said cam disk and vacuum cell coact with the throttle valve associated with the second cylinder unit forming a means for causing, during the warming-up of the engine, a fuel-air mixture to be supplied to the cylinders of the second cylinder group in all operating ranges in an amount that is continuously increased in a first portion of said predetermined partial load range and is continuously decreased to a quantity approximating zero in a remaining portion of the partial load range, and with the engine warmed up for operation, only air to be supplied to said second cylinder group throughout said partial load range.

16. Multicylinder engine according to claim 15, wherein the supply of air only produced by said means for causing, with the engine warmed-up, is continuously increased in a first part of said partial load range, held constant in a second part of the partial laod range, and reduced to an amount approximating zero at the end of the partial load range.

17. Multicylinder engine according to claim 15, wherein said means for causing is operable to continuously reduce the supply of only air between said second part of the partial load range and the end thereof.

18. Multicylinder engine according to claim 17, wherein said means for causing is operable for maintaining said constant supply of air only to the end of the partial load range and abruptly reducing the air supply to said amount approximating zero thereat.

19. Multicylinder engine according to claim 13, wherein said cam disk and vacuum cell coact with the throttle valve associated with the second cylinder unit forming a means for causing, during the warming-up of the engine, a fuel-air mixture to be supplied to the cylinders of the second cylinder group in all operating ranges in an amount that is maintained constant throughout the predetermined partial load range, and with the engine warmed-up for operation, only air to be supplied to said second cylinder group throughout said partial load range.

20. Multicylinder engine according to claim 19, wherein the supply of air only produced by said means for causing, with the engine warmed-up, is continuously increased in a first part of said partial load range, held constant in a second part of the partial load range, and reduced to an amount approximating zero at the end of the partial load range.

21. Multicylinder engine according to claim 20, wherein said means for causing is operable to continuously reduce the supply of only air between said second part of the partial load range and the end thereof.

22. Multicylinder engine according to claim 21, wherein said means for causing is operable for maintaining said constant supply of air only to the end of the partial load range and abruptly reducing the air supply to said amount approximating zero thereat.

23. A multicylinder internal-combustion engine according to claim 16, characterized in that a third curved track interacting with said second control lever of the first cylinder group is an inside track of a first link; and the first curved track interacting with the first control lever of the second cylinder group is an outside track of a second link; and the second curved track interacting with the first control lever of the second cylinder group is an inside track of the second link.

24. A multicylinder internal-combustion engine according to claim 16, characterized in that the control mechanism that can influence the fuel-injection valves that can be actuated electromagnetically, is controlled by a switch-on circuit that can be affected by a temperature switch and a connector switch.

25. A multicylinder internal-combustion engine according to claim 24, characterized in that an electromagnetic venting valve is disposed in the switch-on circuit.

26. A multicylinder internal-combustion engine according to claim 24, characterized in that the ventilating valve, the temperature switch and the connector switch are connected in series.

27. A multicylinder internal-combustion engine according to claim 16, characterized in that the first control lever of the second cylinder group can be influenced through a first further control lever and an equalizer spring by means of a vacuum chamber interacting with the vacuum in the intake pipe of the second cylinder group and the vacuum chamber can be ventilated by the venting valve.

28. A multicylinder internal-combustion engine according to claim 13, characterized in that the first control lever of the second cylinder group, through said first further control lever and a second further control lever, can be influenced by a vacuum chamber interacting with the vacuum in the intake pipe of the second cylinder group, and the vacuum chamber can be vented by the venting valve.

29. A multicylinder internal-combustion engine according to claim 13, characterized in that the control lever of the second cylinder group, in the warming-up phase, rests against the second curved track and the throttle valve is slightly opened during this state.

30. A multicylinder internal-combustion engine according to claim 13, characterized in that the volume of the fuel-air mixture supplied to the second cylinder group stays the same until the end of the predetermined partial load range.

* * * * *